US006173503B1

(12) United States Patent
Houghton et al.

(10) Patent No.: US 6,173,503 B1
(45) Date of Patent: Jan. 16, 2001

(54) ADJUSTABLE GAUGE DEVICE FOR USE IN INSTALLING RAILING SPINDLES

(76) Inventors: Gary D. Houghton, 17 Carrousel La., Mercerville, NJ (US) 08619; John C. Scheideler, 43 Dublin Rd., Pennington, NJ (US) 08534

( * ) Notice: Under 35 U.S.C. 154(b), the term of this patent shall be extended for 0 days.

(21) Appl. No.: 09/227,165

(22) Filed: Jan. 5, 1999

(51) Int. Cl.[7] ..... B43L 7/10
(52) U.S. Cl. ..... 33/454; 33/613
(58) Field of Search ..... 33/376, 452, 454, 33/526, 527, 613, 645

(56) References Cited

U.S. PATENT DOCUMENTS

| | | | | |
|---|---|---|---|---|
| 170,257 | * | 11/1875 | Hall | 33/454 |
| 289,457 | * | 12/1883 | Shields | 33/454 |
| 827,233 | * | 7/1906 | Gould | 33/454 |
| 1,549,671 | | 8/1925 | Kridler et al. | 33/613 |
| 1,612,455 | * | 12/1926 | McGeorge | 33/562 |
| 2,744,334 | | 5/1956 | Jondole | 33/613 |
| 2,991,857 | | 7/1961 | Soderberg | 33/613 |
| 3,201,874 | | 8/1965 | Christy | 33/613 |
| 3,888,477 | | 6/1975 | Tate | 33/613 |
| 4,212,108 | * | 7/1980 | Jackson | 33/645 |
| 4,914,822 | * | 4/1990 | Wetherington | 33/562 |
| 5,163,233 | * | 11/1992 | Benson | 33/613 |
| 5,490,334 | | 2/1996 | Payne | 33/613 |
| 5,491,905 | | 2/1996 | Jablonski et al. | 33/613 |

* cited by examiner

*Primary Examiner*—G. Bradley Bennett
(74) *Attorney, Agent, or Firm*—LaMorte & Associates

(57) ABSTRACT

A gauge device for spacing railing spindles or other parallel building elements used in construction. The gauge device is a generally rectangular assembly having two long edges that are spaced a predetermined distance apart. An adjustment mechanism is embodied within the rectangular assembly for selectively varying the predetermined distance between the two long edges across a range of distances. An indicator is coupled to the adjustment mechanism for indicating the predetermined distance between the two long edges maintained by the adjustment mechanism. Optional level bubbles are provided within the device to provide an indication as to when the long side edges were in a true vertical orientation. The gauge device is used by placing the gauge device between parallel building elements during construction, The gauge device ensures that the building elements are properly spaced and are aligned in the vertical.

14 Claims, 3 Drawing Sheets

ADJUSTABLE GAUGE DEVICE FOR USE IN INSTALLING RAILING SPINDLES

BACKGROUND OF THE INVENTION

1. Field of the Invention

The present invention relates to gauges and jigs that are used during the installation of railing spindles to create uniform spaces between those elements. More particularly, the present invention relates to gauges and jigs for railing spindles that can be selectively adjusted in size.

2. Description of the Prior Art

There are many exposed elevated structures, such as stairs, decks, balconies and the like, that are protected with railing systems. A typical railing system contains one or two horizontal rails. The space between the railings, or the railing and the floor, is filled with vertical railing spindles. The purpose of the railing system is to provide a barrier that would prevent a person from accidently falling off the edge of the elevated structure.

Many different municipalities have adapted standardized building codes that set specifications for the length and spacing of railing spindles in a railing system. A commonly adapted building code requires that railing spindles be spaced no more than four inches apart. Accordingly, when a carpenter builds a railing system, care is taken not to space the railing spindles too far apart, else the railing system will fail inspection from the municipality building inspector.

When building railing systems, carpenters commonly cut a piece of wood to the size desired for the railing spindle spacing. The cut piece of wood is then used as a gauge during the installation of the railing spindles. Although a cut piece of wood works as a spacing gauge, it does have its disadvantages. First, a cut piece of wood is not adjustable. Accordingly, different pieces of wood must be cut at different times if there are designed variations in the layout of the railing spindles. A second disadvantage is that a cut block of wood is not self supporting. Accordingly, a carpenter must manipulate both the block of wood and the railing spindles during the installation process. A third disadvantage of a cut block of wood is that it provides no indication as to whether or not a railing spindle is vertically straight. Rather, the cut block of wood only spaces a railing spindle a predetermined distance from the previous railing spindle. If the previous railing spindle is warped or otherwise not straight, this error is transferred to the next railing spindle through the use of the cut block of wood. Consequently, each railing spindle must be checked with a level and corrected after the cut block of wood is used. This requires a carpenter to manipulate the railing, the cut block and a level in properly positioning each railing spindle.

In the prior art, spindle spacing devices have been developed that improve upon the cut block of wood. Such prior art devices embody adjustments that allow the spacing device to be adjusted to different spacing dimensions. Such prior art spacing devices are exemplified by U.S. Pat. No. 5,491,905 to Jablonski, entitled Apparatus For Accurately Spacing Railing Spindles. However, such prior art spacing devices are time consuming to install. Furthermore, such prior art spacing devices often gauge from the previous railing spindle. Accordingly, if any railing spindle is warped, that error can be transmitted to subsequent railing spindles. A carpenter must therefore still check each railing spindle with a level during construction to ensure each railing spindle is straight.

A need therefore exists in the art of railing spindle spacers for a device that is adjustable, easy to install, self supporting, and eliminates the need for the use of a level. These needs are met by the present invention as is described and claimed below.

SUMMARY OF THE INVENTION

The present invention is a gauge device for spacing railing spindles or other parallel building elements used in construction. The gauge device is a generally rectangular assembly having two long edges that are spaced a predetermined distance apart. An adjustment mechanism is embodied within the rectangular assembly for selectively varying the predetermined distance between the two long edges across a range of distances. An indicator is coupled to the adjustment mechanism for indicating the predetermined distance between the two long edges maintained by the adjustment mechanism. Optional level bubbles are provided within the device to provide an indication as to when the long side edges are in a true vertical and/or horizontal orientation.

The gauge device is used by placing the gauge device between parallel building elements during construction, The gauge device ensures that the building elements are properly spaced and are aligned in the vertical.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention gauge device can be used to space most any parallel construction elements, such as fence rails, framing studs, joists and the like, the present invention gauge device is especially well suited for use in installing railing spindles in a railing system. Accordingly, by way of example, the present invention gauge device will be described in an application where parallel railing spindles are being installed.

Figure 1:
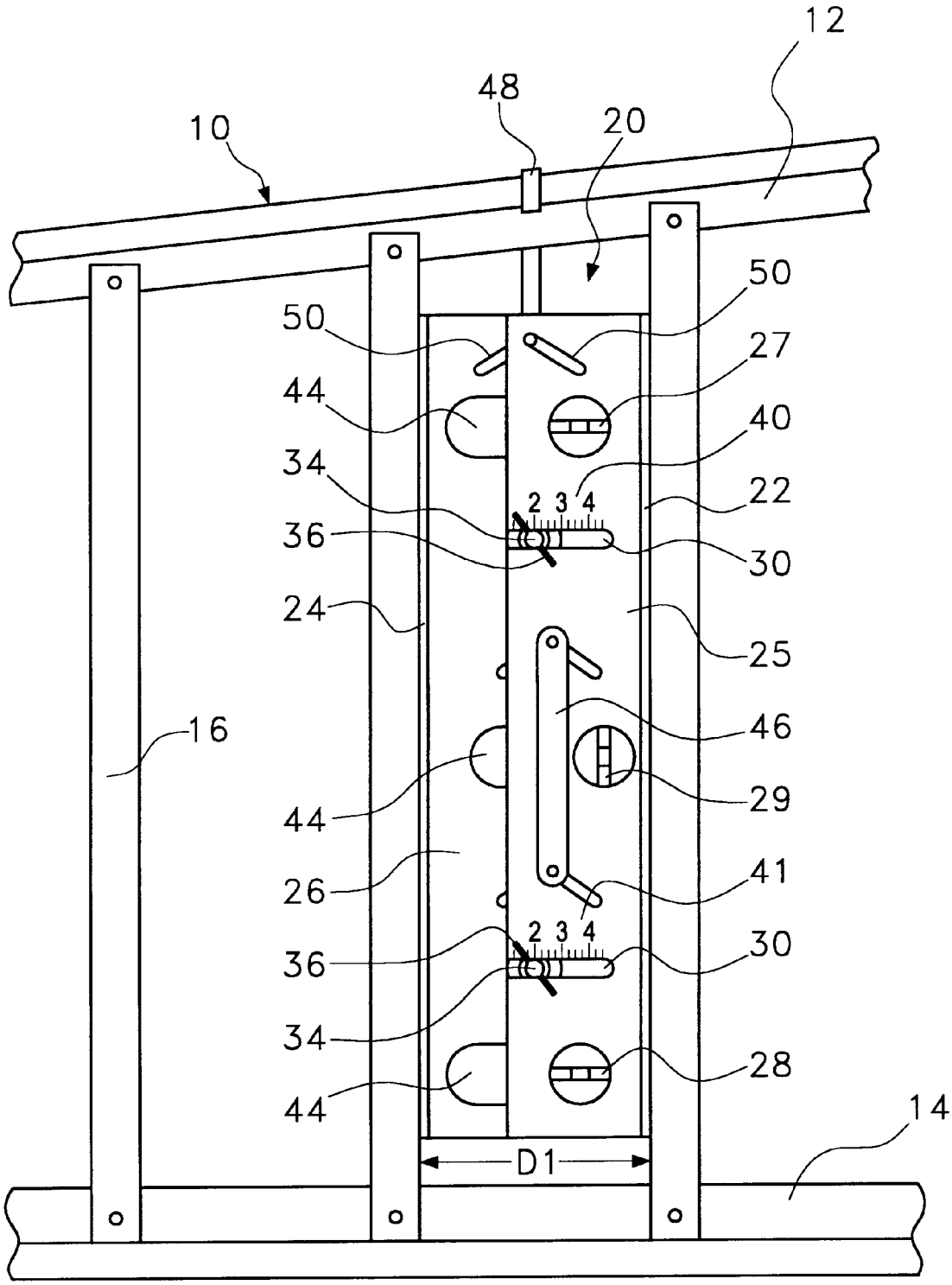
FIG. 1 is a front view of an exemplary embodiment of the present invention gauge device shown in use between railing spindles in a railing assembly.

Referring to FIG. 1, a segment of a typical railing system 10 is shown. The railing system 10 has a top rail 12 and a bottom rail 14. Railing spindles 16 are installed between the top rail 12 and the bottom rail 14. The railing spindles 16 are installed in a vertical orientation, wherein each of the vertical rails 16 are parallel.

In the shown railing system, the top rail 12 is angled and the bottom rail 14 lays in the horizontal. This segment of railing is used to illustrate the versatility of the present invention gauge device 20 by showing that the rails in the railing system 10 need not be parallel for its use.

Figure 2:
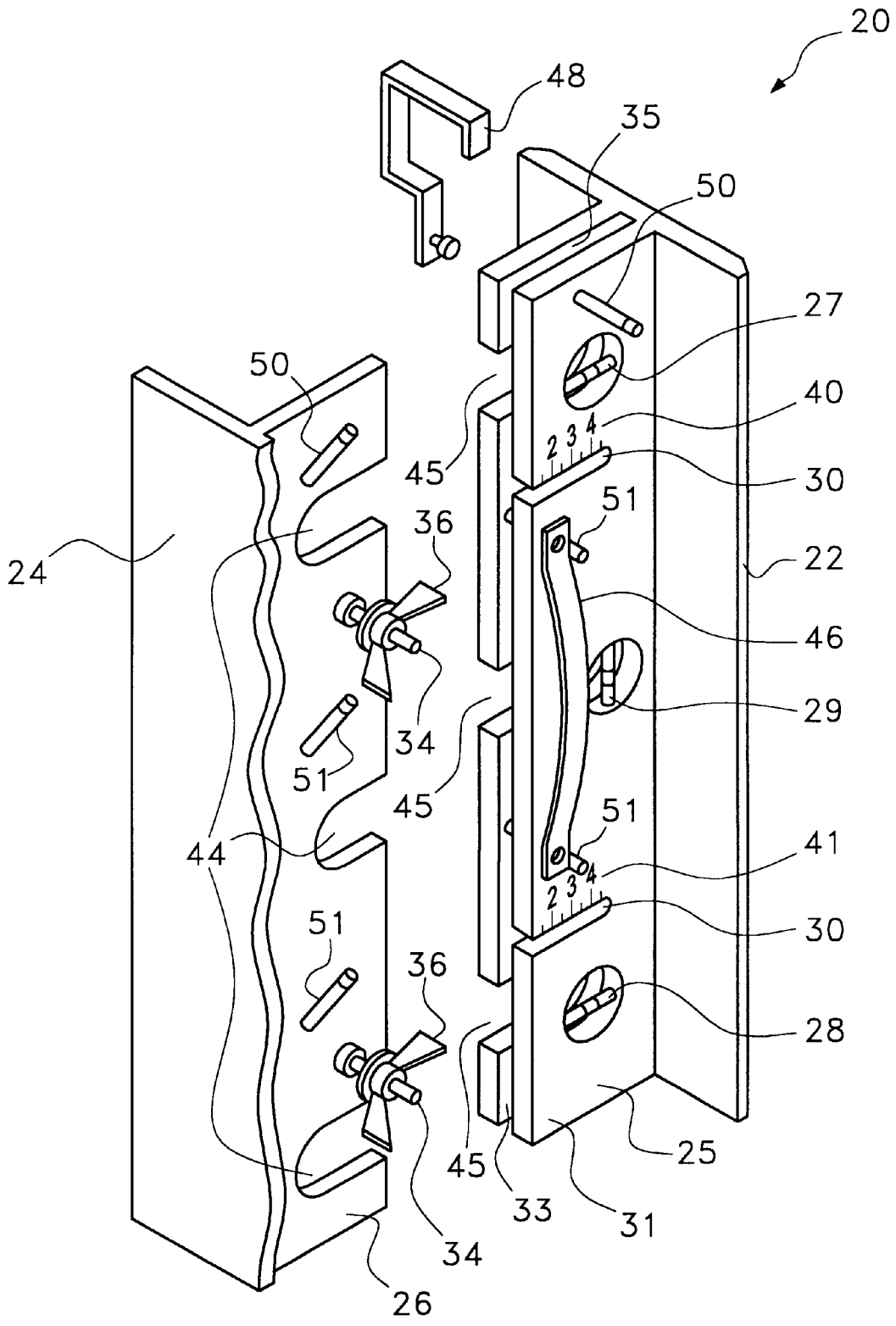
FIG. 2 is an exploded perspective view of the embodiment of the present invention shown in FIG. 1.

Referring to FIG. 2 in conjunction with FIG. 1, it can be seen that the gauge device 20 has two flat side edges 22, 24. The side edges 22, 24 are spaced apart by a predetermined distance D1. However, the distance D1 between the side edges 22, 24 is selectively adjustable within a predetermined range. In the shown application, the gauge device 20 is being used to install railing spindles 16 (FIG. 1). As such, the desired range of adjustment for the predetermined distance D1 is between two inches and four inches. However, if the gauge device 20 were being used to install framing studs, the desired range of adjustment for the predetermined distance D1 would preferably be between fourteen inches and twenty four inches.

In the shown embodiment, each of the side edges 22, 24 of the gauge device 20 is attached to a spanning body element 25, 26, wherein each spanning body element 25, 26 attaches to the middle of its side edge 22, 24 at a perpendicular. The first spanning body element 25 embodies three level bubbles 27, 28, 29. One level bubble 27 is disposed near the top of the first spanning body element 25. One bubble 28 is disposed near the bottom of the first spanning body element 25. Lastly, one level bubble 29 is disposed near the center of the first spanning body element 25. In the shown embodiment, the top and bottom level bubbles 27, 28 are horizontal level bubbles and the middle level bubble 29 is a vertical level bubble.

The presence of the level bubbles 27, 28, 29 in the gauge device 20 enables the gauge device 20 to act as both a spacing gauge and a level when used in the installation of a railing spindle 16 (FIG. 1). As a new railing spindle is placed against a side edge of the gauge device 20, a carpenter can instantly see if that railing spindle is aligned in the vertical. If the new railing spindle is not vertical, it can be checked and corrected using the gauge device 20. The vertical bubble 29 in the gauge device, enables the gauge device to be used as a standard level when the railings and other horizontal elements are installed.

The first spanning body element 25 is generally U-shaped, wherein the first spanning body element 25 has two parallel extending walls 31, 33 (FIG. 2). The two parallel extending walls 31, 33 define an open slot 35 (FIG. 2) that runs the length of the first spanning body element 25.

A second spanning body element 26 extends from the second edge 24 of the gauge device 20. The second spanning body element 26 is sized to fit between the two parallel extending walls 31, 33 of the first spanning body element 25 on the opposite side of the gauge device 20. The degree of penetration of the second spanning body 26 into the first spanning body element 25 determines the distance D1 between the two side edges 22, 24. In the shown embodiment, the degree of penetration of the second spanning body element 26 into the first spanning body element 25 is controlled through the use of locking bolts. Two adjustment slots 30 are formed in the first spanning body element 26. The adjustment slots 30 are open on the edge of the first spanning body element 25 that faces the second spanning body element 26.

Locking bolts 34 extend from the second spanning body element 26. The bolts 34 are engaged by butterfly locking nuts 36 that can be manually tightened and loosened. As the first spanning body element 25 passes over the second spanning body element 26, the locking bolts 34 on the second spanning body element 26 pass into the adjustment slots 30 of the first spanning body element 25. Once a desired degree of penetration is obtained, the butterfly nuts 36 are tightened, thereby locking the first spanning body element 25 and the second spanning body element 26 into a fixed orientation.

The degree of penetration between the first spanning body element 25 and the second spanning body element 26 determines the distance D1 between the opposing flat side edges of the gauge device 20. Numeric indicia 41 are provided along the edge of the adjustment slots 30 in the first spanning body element 25. As the first spanning body element 25 and the second spanning body element 26 engage, the edge of the second spanning body element 26 aligns with one of the numeric indicia 41. The numeric indicia 41 are scaled to provide an accurate indication as to the width of the gauge device 20 depending upon which of the numeric indicia 41 the edge of the second spanning body element 26 aligns. Thus, if the edge of the second spanning body element 26 aligns with the numeric indicia "3", as viewed through an adjustment slot, it can be determined that the distance D1 between the side edges 22, 24 of the gauge device 20 is three inches.

In FIG. 2, optional guide shanks 40 are shown extending from the bottom of the locking bolts 34. The guide shanks 40 are sized to engage the adjustment slots 30 formed in the first spanning body element 25. The presence of the guide shanks 40 in the adjustment slots 30 maintains the first spanning body element 25 in a parallel orientation with respect to the second spanning body element 26 as the two spanning body elements 25, 26 are moved in relation to one another.

With returning reference to both FIG. 1 and FIG. 2, it can be seen that level reliefs 44 are formed in the second spanning body element 26. The level reliefs 44 on the second spanning body element 26 align with the level bubbles 27, 28, 29 in the first spanning body element 25. A second set of level reliefs 45 are also formed in the second extending wall of the first spanning body element 25. The second set of level reliefs also align with the level bubbles 27, 28, 29. Accordingly, when the first spanning body element 25 and the second spanning body element 26 overlap, the various level bubbles 27, 28, 29 can still be seen from both sides of the gauge device 20.

In certain circumstances, a carpenter may not want to manually hold the gauge device 20 in place. For that reason the gauge device 20 is self supporting. A hook element 48 is provided. The hook element 48 can be selectively attached or detached from the gauge device 20. The hook element 48 is shaped to engage the upper rail of a railing system. Accordingly, by placing the hook element 48 on a railing and suspending the gauge device 20 from the hook element 48, the gauge device 20 can be self supporting at any point below the top rail of a railing system.

In usage, it would be convenient if the gauge device 20 were to hang directly vertical from the hook element 48. In order for that orientation to occur, the hook element 48 must engage the gauge device 20 at a point directly above the center of gravity for the gauge device 20. This problem, however, is complicated by the fact that the center of gravity of the gauge device 20 changes as the width of the gauge device 20 is adjusted.

To compensate for the changing center of gravity, an angled slot 50 is formed near the top of both the first spanning body element 25 and the second spanning body element 26. As the gauge device 20 is adjusted in width, the point of intersection between the two slots 50 changes. The slope of the two slots 50 is calculated so that the point of intersection between the two slots 50 always occurs directly above the center of gravity for the gauge device 20. Accordingly, by engaging the hook element 48 with the angled slots 50, the hook element 48 is always above the center of gravity for the gauge device 20 and the gauge device 20 lays in the vertical.

A handle 46 is attached to the face of the first spanning body element 25. The handle 46 provides an object for the carpenter to grasp when manipulating the gauge device 20. The handle 46 is preferably positioned proximate the center of gravity of the gauge device 20, thereby enabling the gauge device 20 to be manipulated in a balanced manner with only one hand. However, as has already been described, the center of gravity of the gauge device 20 changes as the gauge device is adjusted. Accordingly, the handle 46 can be attached to the gauge device in the same manner as the hook element 48. To compensate for the changing center of gravity, an angled slot 51 is formed in both the first spanning body element 25 and the second spanning body element 26 at points corresponding to the top and the bottom of the handle 46. As the gauge device 20 is adjusted in width, the point of intersection between the two slots 51 changes. The slope of the two slots 51 is calculated so that the point of intersection between the two slots 51 always occurs directly above the center of gravity for the gauge device 20. Accordingly, by engaging the handle 46 with the angled slots 51, the handle 46 is always above the center of gravity for the gauge device 20.

Figure 3:
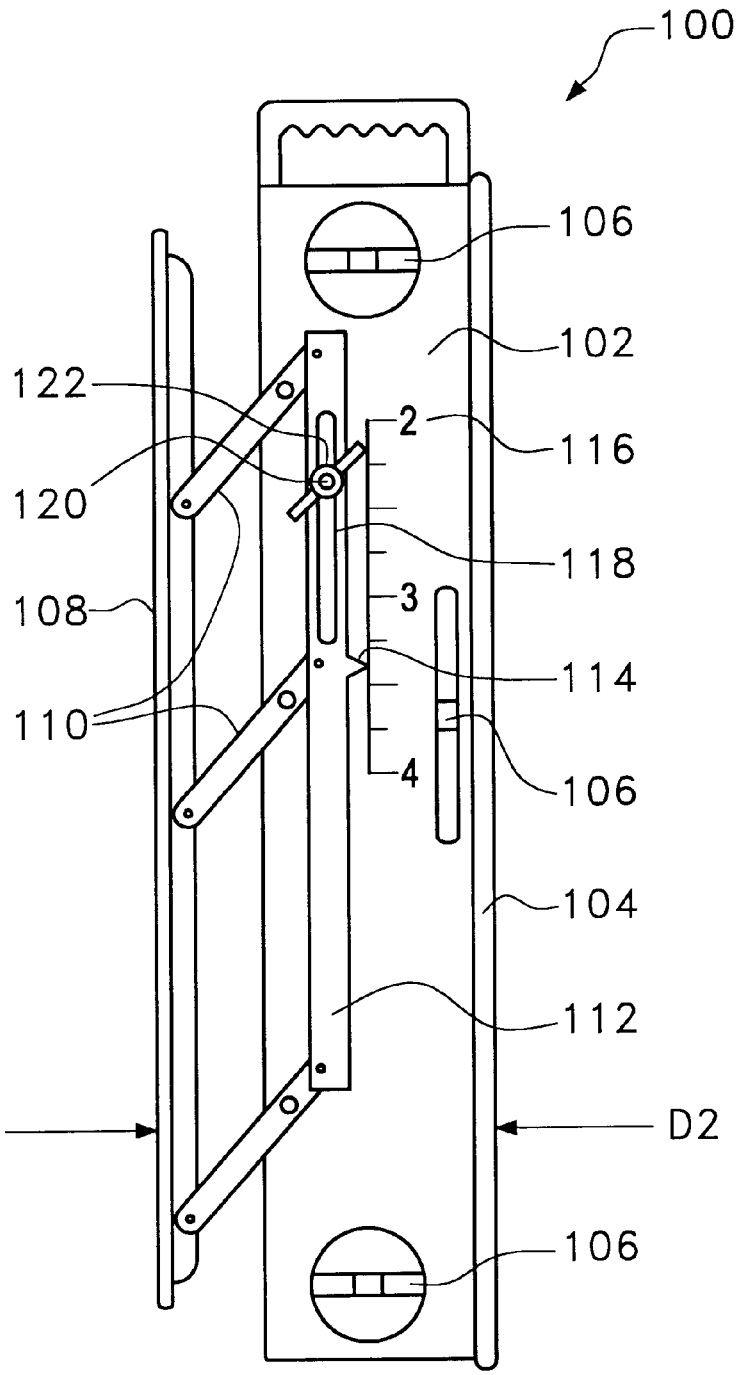
FIG. 3 is a front view of an alternate embodiment of a gauge device in accordance with the present invention.

Referring now to FIG. 3, an alternate embodiment of the present invention is shown. In this embodiment, the gauge device 100 has a main body 102. One side of the main body 102 terminates with a flat side edge 104. The main body 102 also contains three level bubbles 106 that enable the gauge device to act as a level during the installation of railing spindles.

The gauge device 100 also has a second side edge 108 that can be moved in relation to the main body 102. Accordingly, the distance D2 between the two side edges 106, 108 can be selectively varied. The second side edge 108 is connected to a series of linkages 110. The linkages 110 are pivotably connected to the main body 102 of the gauge device 100. A control bar 112 connects to the ends of the linkages 110 opposite the second side edge 108. As the control bar 112 moves up and down, the linkages 110 pivot around their pivot points and vary the distance between the second side edge 108 and the main body of the gauge device 100.

A position indicator 114 extends from the control bar 112. The position indicator 114 passes along a scale of numeric indicia 116 present on the main body 102 of the gauge device 100. The numeric value pointed to by the position indicator 114 is indicative of the distance D2 between the two side edges 104, 108 of the gauge device 100.

A slot 118 is formed in the control bar 112. A bolt 120 extends through the slot 118. By tightening a nut 122 onto the bolt 120, the position of the control bar 112 on the main body 102 of the gauge device 100 can be controlled. Accordingly, the distance D2 between the opposite side edges 106, 108 of the gauge device 100 can also be selectively controlled.

It will be understood that the various figures described above illustrate only two preferred embodiments of the present invention. A person skilled in the art can therefore make numerous alterations and modifications to the shown embodiment utilizing functionally equivalent components to those shown and described. For example, there are numerous ways to vary the distance between the edges of the gauge device. Any such prior art length adjustment mechanism can be substituted for the elements described. All such modifications are intended to be included within the scope of the present invention as defined by the appended claims.

What is claimed is:

1. A gauge device for spacing railing spindles, comprising:

a rectangular assembly having two long edges spaced a predetermined distance apart, wherein said rectangular assembly has a center of gravity;

an adjustment mechanism embodied in said rectangular assembly for selectively varying said predetermined distance across a range of distances, wherein the center of gravity of said rectangular assembly varies in position as said adjustment mechanism is used to adjust said predetermined distance between said long side edges;

an indicator coupled to said adjustment mechanism for indicating said predetermined distance between said two long edges maintained by said adjustment mechanism; and an attachment mechanism that enables said device to be suspended at a point above the center of gravity regardless of the position of the center of gravity.

2. The device according to claim 1, wherein said rectangular assembly includes at least one leveling bubble.

3. The device according to claim 1, wherein said range of distances includes the range from two inches to four inches.

4. The device according to claim 1, further including a handle extending from said rectangular assembly between said long side edges.

5. The device according to claim 1, wherein said rectangular assembly includes a first side edge coupled to a first spanning body element and a second side edge coupled to a second spanning body element, wherein said first spanning body element and said second spanning body element overlap.

6. The device according to claim 5, wherein said adjustment mechanism is at least one nut and bolt that binds said first spanning element to said second spanning element when a predetermined degree of overlap between the elements is achieved.

7. The device according to claim 6, further including numeric indicia disposes on said first spanning element that enables said predetermined degree of overlap to be scaled.

8. The device according to claim 5, wherein said first spanning body element and said second spanning body element both contain angled slots that overlap, wherein a point of intersection between said angled slots is present above the center of gravity throughout said predetermined range of distances.

9. The device according to claim 8, further including a hook element sized to engage said point of intersection between said angled slots.

10. A spacing gauge device for spacing construction elements, comprising:

a first flat edge;

a second flat edge aligned in parallel to said first flat edge a predetermined distance from said first flat edge;

an adjustment mechanism disposed between said first flat edge and said second flat edge for selectively adjusting said predetermined distance through a range of distances, wherein said device has a center of gravity that varies in position as said adjustment mechanism is used to adjust said predetermined distance between said first flat edge and said second flat edge;

at least one first leveling bubble disposed between said first flat edge and said second flat edge for indicating when said first flat edge and said second flat edge are vertical; and an attachment mechanism that enables said device to be suspended at a point above the center of gravity regardless of the position of the center of gravity.

11. The device according to claim 10, wherein said range of distances includes the range from two inches to four inches.

12. The device according to claim 10, further including a handle disposed between said first flat edge and said second flat edge.

13. The device according to claim 10, wherein further including an indicator disposed between said first flat edge and said second flat edge that provides a visual numeric indication as to said predetermined distance between said first said flat edge and said second flat edge.

14. The device according to claim 10, further including at least one second leveling bubble disposed between said first flat edge and said second flat edge for indicating when said first flat edge and said second flat edge are horizontal.

* * * * *